US005425820A

United States Patent [19]

Yashiki et al.

[11] Patent Number: 5,425,820

[45] Date of Patent: Jun. 20, 1995

[54] ORIENTED MAGNETIC STEEL SHEETS AND MANUFACTURING PROCESS THEREFOR

[75] Inventors: Hiroyoshi Yashiki, Kobe; Teruo Kaneko, Hyogo; Takashi Tanaka, Nishinomiya, all of Japan

[73] Assignee: Sumitomo Metal Industries, Ltd., Osaka, Japan

[21] Appl. No.: 1,618

[22] Filed: Jan. 8, 1993

[30] Foreign Application Priority Data

Jan. 10, 1992 [JP] Japan ..... 4-003025

[51] Int. Cl.[6] ..... H01F 1/147

[52] U.S. Cl. ..... 148/307; 148/308; 420/72; 420/117

[58] Field of Search ..... 148/307, 308; 420/72, 420/117

[56] References Cited

U.S. PATENT DOCUMENTS

| | | | |
|---|---|---|---|
| 2,172,626 | 9/1939 | Snoek | 148/307 |
| 5,250,123 | 10/1993 | Yashiki et al. | 148/111 |

FOREIGN PATENT DOCUMENTS

| | | | |
|---|---|---|---|
| 503680 | 9/1992 | European Pat. Off. . | |
| 1-119644 | 8/1989 | Japan . | |
| 1-319632 | 12/1989 | Japan . | |
| 3-140442 | 6/1991 | Japan . | |
| 0487254 | 6/1938 | United Kingdom | 420/117 |
| 1100771 | 1/1968 | United Kingdom . | |

*Primary Examiner*—John P. Sheehan

*Attorney, Agent, or Firm*—Burns, Doane, Swecker & Mathis

[57] ABSTRACT

An oriented magnetic steel sheet with a very low core loss and a process for manufacturing it at a lower cost are disclosed. The steel sheet consists essentially of Si: greater than 3.0% and at most 6.0%, Mn: greater than 2.0% and at moat 8.0%, sol. Al: 0.003–0.015%, with Si (%)$-0.5\times$Mn (%)$\leqq 2.0$ and the balance being Fe and incidental impurities, The amounts of C, N, and S as impurities are respectively at most 0.005%, at most 0.006%, and at most 0.01%. This steel sheet can be produced from a slab containing up to 0.01% C., up to 0.01% S and 0.001–0.010% N by (i) hot rolling the slab to obtain a hot-rolled steel sheet, (ii) cold rolling the hot-rolled steel sheet, as hot-rolled or after being subsequently annealed, one or more times with an intermediate annealing performed between successive stages of cold rolling to prepare a cold-rolled sheet, (iii) causing primary recrystallization by continuous annealing of the cold-rolled sheet, and (iv) finish annealing the continuously annealed steel sheet. The cold rolling may be carried out at a sheet temperature of 70°–300° C. The finish annealing preferably comprises causing secondary recrystallization by holding the annealed sheet in a temperature range of 825°–925° C. for 7–100 hours in a nitrogen-containing atmosphere, and holding the secondary-recrystallized sheet in a temperature range greater than 925° C. and up to 1050° C. for 4–100 hours in a hydrogen atmosphere to carry out purification annealing.

7 Claims, No Drawings

ORIENTED MAGNETIC STEEL SHEETS AND MANUFACTURING PROCESS THEREFOR

BACKGROUND OF THE INVENTION

This invention relates to grain-oriented magnetic steel sheets or strips which are extensively used to make magnetic shields and cores in transformers, generators, and motors. The present invention also relates to a process for manufacturing such oriented steel sheets.

Oriented steel sheets are soft magnetic materials that have a crystallographic orientation in which the {110}<001> orientation, generally referred to as the Goss orientation, is dominant. They have excellent excitation and core loss characteristics in the rolling direction.

A typical process for producing oriented steel sheets comprises the steps of hot-rolling a slab of steel containing about 3.0% Si to obtain a hot-rolled sheet and then cold-rolling the hot-rolled sheet one or more times to attain a final sheet thickness, either immediately after hot rolling or after annealing the hot-rolled sheet. Intermediate annealing is conducted between successive stages of cold rolling. The sheet is then subjected to a continuous decarburization annealing to cause primary recrystallization, followed by application of a parting agent for preventing fusion or seizure, winding the sheet in a coil, and further performing finish annealing at a very high temperature of 1100°-1200° C. The purpose of the finish annealing is two-fold; it is conducted to cause secondary recrystallization, thereby forming a textured structure in which integration in the Goss orientation is dominant, and it is also conducted to remove the precipitate, called an "inhibitor", which has been used to cause secondary recrystallization. The step of removing the precipitate is also known as "purification annealing" and may be regarded as an essential step for obtaining satisfactory magnetic characteristics.

One major disadvantage of oriented magnetic steel sheets produced by the method described above is their extremely high cost since the production process involves special steps such as continuous decarburization annealing and finish annealing at extra-high temperatures of at least 1100° C.

Various R&D efforts have been made with a view of solving this cost problem. For example, the present inventors developed an oriented magnetic steel sheet chiefly characterized by comprising 0.5-2.5% Si, 1.0-2.0% Mn, 0.003-0.015% sol. Al, up to 0.01% C and 0.001-0.010% N, as well as a process for its production that did not need decarburization annealing but which was capable of low-temperature annealing (Japanese Published Unexamined Patent Application No. 1-119644/1989). That process is anticipated to make a great contribution to reducing the cost of oriented magnetic steel sheets by omitting the step of continuous decarburization annealing while lowering the temperature for finish annealing.

Due to an ever-growing societal demand for energy conservation, there is a strong impetus to reduce the core loss of oriented magnetic steel sheets.

SUMMARY OF THE INVENTION

Accordingly, it is an object of the present invention to provide an oriented steel sheet and a process for its manufacture, the sheet having properties superior to those described in Japanese Published Unexamined Patent Application No. 1-119644/1989, described above.

Another object of the present invention is to provide an oriented magnetic steel sheet with a very low core loss, as well as a process for its manufacture.

Core losses can be roughly divided into hysteresis losses and eddy current losses. Hysteresis losses can be decreased by raising the degree of integration of the Goss orientation or by decreasing the level of impurities, while eddy current losses can be decreased by increasing the resistivity of the steel sheet and decreasing the sheet thickness. However, efforts to increase the integration of the Goss orientation or to decrease the levels of impurities have virtually reached practical limits. Although it is still possible to decrease eddy losses by decreasing the thickness of steel sheets, decreasing the sheet thickness inevitably results in increased manufacturing costs.

The resistivity of a steel sheet can be increased by raising the Si content, but increases in the Si content results in a degradation in the workability of the steel sheet and cold rolling becomes difficult. Therefore, in actual practice, it is impractical to raise the Si content above 3.3%. For this reason, in Japanese Published Unexamined Patent Application No. 1-119644/1989, the Si content of a magnetic steel sheet is restricted to at most 2.5% by weight. Accordingly, attempts to decrease core losses by increasing the Si content to raise the resistivity have reached practical limits.

As a result of investigations aimed to finding a method of increasing the resistivity of steel sheets without degrading workability, the present inventors made the following discoveries.

(1) Even if the Si content of a steel sheet exceeds 3%, if the Mn content satisfies the formula $$Si(\%)-0.5\times Mn(\%)\leqq 2.0$$

decreases in workability can be restrained, and the occurrence of secondary recrystallization at the time of finish annealing can be stabilized.

(2) The workability at the time of cold rolling of a steel containing Si and Mn in amounts satisfying the above formula can be enormously increased if the cold rolling is performed when the steel sheet is in a temperature range of 70°-300° C.

(3) Like Si, Mn has the effect of increasing the resistivity of steel sheet, and it is extremely effective at decreasing core losses.

(4) In a steel with a high content of Si and Mn, in order to initiate secondary recrystallization, it is effective in the first half of finish annealing to maintain the steel in an environment including $N_2$ at a temperature of 825°-925° C., and in order to remove nitrides which function as inhibitors, it is effective in the last half of finish annealing to perform purification annealing in an $H_2$ atmosphere at a temperature greater than 925° C. and at most 1050° C.

Accordingly, an oriented magnetic steel sheet according to the present invention consists essentially of, on a weight basis, of Si: greater than 3.0% and at most 6.0%, Mn: greater than 2.0% and at most 8.0% sol. Ai: 0,003-0.015% with Si (%)$-0.5\times$Mn (%)$\leqq$2.0 and a balance of Fe and incidental impurities, wherein the amounts of C, N, and S as impurities are C: at most 0.005%, N: at most 0.006%, and S: at most 0.01%.

A manufacturing process for an oriented magnetic steel sheet according to the present invention comprises subjecting a steel slab having a composition consisting essentially of C: at most 0.01%, Si: greater than 3.0% and at most 6.0% and more preferably at most 4.0%, Mn: greater than 2.0% and at most 8.0% and more preferably at most 4.0%

S: at most 0.01%, sol. Al: 0.003–0.015%1

N: 0.001–0.010%, with Si (%)$-0.5\times$Mn (%)$\leqq 2.0$ and a balance of Fe and incidental impurities to the following steps:

(i) hot rolling the slab to obtain a hot-rolled steel sheet;

(ii) cold rolling the hot-rolled steel sheet, either as hot-rolled or after being subsequently annealed, one or more times with an intermediate annealing performed between successive stages of cold rolling to prepare a cold-rolled sheet;

(iii) causing primary recrystallization by continuous annealing of the cold-rolled sheet; and (iv) performing finish annealing.

The cold rolling step is preferably carried out such that the temperature of the sheet being cold rolled is 70°–300° C.

The finish annealing is preferably carried out by causing secondary recrystallization by holding the annealed sheet in a temperature range of 825°–925° C. for 7–100 hours in a nitrogen-containing atmosphere, and holding the secondary-recrystallized sheet in a temperature range above 925° C. and up to 1050° C. for 4–100 hours in a hydrogen atmosphere to carry out purification annealing.

A parting agent may be applied to the steel sheet after the continuous annealing and before the finish annealing.

DESCRIPTION OF THE PREFERRED EMBODIMENTS

A magnetic steel sheet according to the present invention is manufactured from a steel slab having a prescribed composition. The limits on the content of each component of this composition will be described below.

(a) C and N

The presence of carbon (C) and nitrogen (N) has an adverse effect on the properties of magnetic steel sheet. Therefore, in the finished steel sheet, it is necessary to limit the C content to at most 0.005% and the N content to at most 0.006%. Preferably, the C content is at most 0.003% and the N content likewise at most 0.003%. The reason for these limits is that C and N remaining in the final product form carbides and nitrides which obstruct domain-wall mobility, resulting in an increase in core loss.

However, if the C content of the steel slab which serves as a raw material is made at most 0.01%, even if the annealing after the final stage of cold rolling is not decarburization annealing, secondary recrystallization during finish annealing is not impeded. It is also possible to decrease the C content to a desired level during purification annealing in the last half of finish annealing. Therefore, the C content in the steel slab is restricted to at most 0.01%.

Nitrogen is necessary for forming inhibitor nitrides and should be present until after secondary recrystallization is completed. If the N content is less than 0.001% in the starting steel slab, the precipitation of nitrides is too small to provide the desired inhibitor effect. On the other hand, the effectiveness of N saturates when present in an amount exceeding 0.010%. Hence, the range of 0.001–0.010% is preferable for the N content. The N content can also be reduced to a level of at most 0.006% during the purification annealing.

(b) Si

Silicon (Si) causes substantial effects on magnetic characteristics. The higher its content, the higher the electric resistance of the steel sheet and the lower the eddy-current loss, leading to a smaller core loss. However, if the Si content exceeds 6.0%, the workability decreases to make subsequent cold rolling difficult to achieve. Therefore, the upper limit on the Si content is preferably 6.0% and more preferably 4.0%. On the other hand, if the Si content is 3.0% or below, the electric resistance of the steel sheet is too low to reduce the core loss. Therefore, the Si content is preferably greater than 3.0% and preferably at most 6.0% and more preferably at most 4.0%.

(c) Mn

Manganese (Mn) is effective at causing $\alpha$–$\gamma$ transformation in the slabs of high Si and extra-low carbon steels such as the steel of the present invention. That transformation promotes the refining and homogenization of the structure of the sheet being hot rolled. As a result, secondary recrystallization characterized by a higher degree of integration in the Goss orientation will occur in a stable way in the finish annealing, and the workability of a high-Si steel is improved.

The development of $\alpha$–$\gamma$ transformation is determined by the balance between the content of Si, which is a ferrite-forming element, and Mn, which is an austenite-forming element. Hence, a suitable content of each of Si and Mn is determined by the content of the other. In the present invention, Mn is contained in such an amount as to satisfy the condition Si (%)$-0.5\times$Mn (%)$\leqq 2.0$. This is necessary for causing the appropriate transformation in the hot-rolled sheet. In the case where Si is contained in an amount of greater than 3.0%, at least 2.0% of Mn is necessary in order to satisfy the condition set forth above. Furthermore, when the Si content is 6.0%, the Mn content must be at least 8.0%. However, an Mn content of greater than 8.0% results in a degradation in cold workability. Therefore, the upper limit on the Mn content is preferably 8.0% and more preferably 4.0%.

Like Si, Mn is effective for raising the electrical resistance of a steel sheet. From the standpoint of decreasing core loss, the Mn content should be greater than 2.0%. Accordingly, the Mn content is preferably greater than 2.0% and preferably at most 8.0% and more preferably at most 4.0% and satisfies the formula Si(%)$-0.5\times$Mn(%)$\leqq 2.0$.

(d) S

Sulfur (S) combines with Mn to form MnS. In the present invention, AlN, (Al,Si)N, and Mn-containing nitrides are used as principal inhibitors. In other words, MnS which is used in ordinary oriented magnetic steel sheets is not used as a principal inhibitor in the present invention. Hence, there is no need to add S in large amounts. If large amounts of MnS grains remain in the product steel, its core loss characteristics will deteriorate. Further, the temperature for finish annealing is at most 1050° C. in the present invention, so one cannot expect a desulfurizing effect to occur in the step of purification annealing. Therefore, the S content is controlled to be no more than 0.010% whether in the final product or the starting steel slab. For reducing the core loss, the S content is preferably at most 0.005%.

(e) Sol. Al

Aluminum (Al) is an important element that forms nitrides such as Al N and (Al,Si)N, which are principal inhibitors playing an important role in the development of secondary recrystallization. If the Al content is less than 0.003% in terms of sol. Al, the inhibitor effect will be inadequate. However, if the amount of sol. Al exceeds 0.015%, not only does the inhibitor level become excessive but it is also dispersed inappropriately, making it impossible to cause secondary recrystallization in a stable way.

Next, the steps in manufacturing a steel sheet according to the present invention will be described.

(f) First Step (hot rolling)

The starting steel slab has the composition specified in the preceding paragraphs. It may be a slab produced by continuous casting of a molten steel that is prepared in a converter, an electric furnace, etc. and that is optionally subjected to any necessary treatment such as vacuum degassing, or it may be produced by blooming an ingot of that molten steel. The conditions for hot rolling are not limited in any particular way but preferably the heating temperature is 1150°–1270° C. and the finishing temperature is 700°–900° C.

(g) Second Step (cold rolling)

The hot-rolled steel sheet is cold-rolled either once or a plurality of times to achieve a predetermined thickness of the product sheet. In this case, annealing (generally referred to as "hot-rolled sheet annealing") may be performed prior to the start of cold rolling. Hot-rolled sheet annealing promotes the optimization of the state of dispersion of precipitates and the homogenization of the microstructure of the hot-rolled sheet due to recrystallization. Hence, it is effective at stabilizing the development of secondary recrystallization during finish annealing.

If hot-rolled sheet annealing is to be accomplished by continuous annealing, soaking is preferably conducted at 700°–1100° C. and more preferably at 750°–1100° C. If annealing is to be performed by box annealing, soaking is preferably conducted at 650°–950° C.

If cold rolling is to be performed a plurality of times, an intermediate annealing step is performed between successive stages of cold rolling. This intermediate annealing is preferably conducted at a temperature of 700°–1000° C. In order to attain a satisfactory structure of primary recrystallization by continuous annealing, the reduction in thickness to be achieved upon completion of the cold rolling is preferably 40–90%, with even better results being effectively attained by a reduction of 60–90%.

If the temperature of the steel sheet during cold rolling is at least 70° C., the workability of the steel sheet is improved, and the incidence of breakage during rolling is greatly decreased. The higher the temperature of the sheet during cold rolling the higher the greater the improvement in the cold rolling characteristics of the sheet. However, if the temperature of the steel sheet during cold rolling exceeds 300° C., the surface of the sheet oxidizes, which is undesirable. Therefore, the temperature of the steel sheet during cold rolling is preferably 70°–300° C.

When a plurality of stages of cold rolling are performed, it is desirable that the steel sheet be within the above-described temperature range for each pass. It is necessary for the sheet temperature during cold rolling at least when the sheet has a thickness of 1.0 mm or above.

(h) Third step (continuous annealing before finish annealing—primary recrystallization annealing)

In order to insure that stable secondary recrystallization will occur in the finish annealing to be described below, primary recrystallization by rapid heating is necessary. For this purpose, continuous annealing is effective. The annealing temperature is preferably 700°–1000° C.

(i) Fourth step (finish annealing)

Finish annealing is performed in order to produce secondary recrystallization and produce an integrated structure in which the Goss orientation is integrated. In the present invention, the finish annealing preferably consists of annealing (first annealing) in the first half of annealing in order to develop secondary recrystallization and subsequent annealing (second annealing) which is intended to remove precipitates (purification).

To develop secondary recrystallization, annealing in a nitrogen-containing atmosphere is necessary. This is for preventing the occurrence of unstable secondary recrystallization due to the decrease in inhibitor nitrides upon denitration. One reason for this practice is in order to increase the precipitation of inhibitor nitrides by nitrogen absorption from the annealing atmosphere so as to induce the occurrence of secondary recrystallization that is characterized by a higher degree of integration in the Goss orientation. To meet this need, the content of $N_2$ in the annealing atmosphere is preferably at least 10 vol % (it may be composed of 100 vol % $N_2$). The non-$N_2$ gaseous component of the annealing atmosphere may be $H_2$ or Ar, with the former being more common.

The effective temperature range for causing secondary recrystallization is 825°–925° C. Below 825° C., the inhibitors which are used have such a strong power of inhibiting grain growth that secondary recrystallization will not occur. On the other hand, the inhibitor effect is so weak in the temperature range exceeding 925° C. that either secondary recrystallization characterized by a low degree of integration in the Goss orientation will occur, or alternatively the normal grains will grow to coarsen the grains of primary recrystallization. The temperature in the range of 825°–925° C. is held for at least 7 hours, but there is no advantage to holding it for more than 100 hours, and doing so is economically disadvantageous. For these reasons, the first half of the finish annealing process (first annealing) is accomplished by holding the steel sheet at 825°–925° C. for 7–100 hours in a nitrogen-containing atmosphere in order to cause secondary recrystallization.

Once secondary recrystallization has occurred, the inhibitor nitrides are deleterious to magnetic characteristics and must be removed. This removal is performed by the second annealing comprising purification annealing. It can be effectively accomplished by annealing in an $H_2$ atmosphere. An adequate effect can not be obtained at a temperature of 925° C. and below, and more preferably the purification annealing is carried out a temperature of at least 950° C. However, there is no advantage to employing a temperature exceeding 1050°

C. since the effect of annealing to remove nitrides saturates. The temperature for purification annealing must be held for at least 4 hours but holding for more than 100 hours is unnecessary. Therefore, the second half of the finish annealing process (second annealing) is to be accomplished by performing purification annealing in a temperature range exceeding 925° C. but not exceeding 1050° C. for 4–100 hours in an $H_2$ atmosphere.

As in the process for producing conventional oriented magnetic steel sheets, a parting agent may be applied before finish annealing so as to prevent seizure that may occur during annealing. Steps to be adopted after finish annealing are also the same as in the case of conventional oriented magnetic steel sheets; after removing the parting agent, an insulating coat may be applied or flattening annealing may be carried out as required.

The present invention will be further described in conjunction with the following working examples which are presented merely for illustrative purposes.

(Example 1)

Steel slabs having the compositions given in Table 1 were prepared by a process consisting of melting in a converter, compositional adjustment by treatment under vacuum, and continuous casting. The slabs were hot rolled at an elevated temperature of 1250° C. and finished to a thickness of 2.0 mm at 830° C. The test steels had a much higher resistivity than conventional oriented magnetic steel sheets (with a resistivity of approximately 50 μΩcm). The balance of Si and Mn was varied so as to maintain the resistivity substantially constant. Subsequently, the hot-rolled sheets were annealed by soaking at 880° C. for 1 minute, descaled by pickling, and cold rolled to a thickness of 0.30 mm by one stage of rolling.

Steels No. 1–3 which had compositions outside the range of the present invention developed cracks in the edge portions of the steel sheets during cold rolling and ended up breaking, so cold rolling to a desired thickness could not be carried out. In contrast, hot rolled Steels No. 4 and 5 according to the present invention suffered no breakage and could be cold rolled to form steel sheets of a desired thickness.

TABLE 1

| Run No. | Composition of stee slab (wt %) C | Si | Mn | S | sol. Al | N | Fe + Impurities | Si (%) - 0.5 × Mn (%) | Resistivity (μΩ · cm) | Remarks |
|---|---|---|---|---|---|---|---|---|---|---|
| 1 | 0.0030 | 4.56 | 0.08 | 0.003 | 0.007 | 0.0042 | Bal. | 4.52 | 65 | X |
| 2 | 0.0029 | 4.02 | 1.20 | 0.003 | 0.008 | 0.0040 | " | 3.42 | 66 | X |
| 3 | 0.0030 | 3.51 | 2.25 | 0.003 | 0.007 | 0.0038 | " | 2.39 | 66 | X |
| 4 | 0.0035 | 3.22 | 2.82 | 0.003 | 0.006 | 0.0037 | " | 1.81 | 66 | ○ |
| 5 | 0.0030 | 3.10 | 3.00 | 0.003 | 0.008 | 0.0041 | " | 1.60 | 65 | ○ |

NOTE -
○: Present Invention
X: Comparative (Example 2)

A cold rolled sheet (0.30 mm thick) obtained in Example 1 of Steel No. 5 was subjected to continuous annealing by soaking at 880° C. for 30 seconds in a 75 vol % $N_2$+25 vol % $H_2$ non-decarburizing atmosphere having a dew point of −20° C. so as to cause primary recrystallization, followed by application of a parting agent and a finish annealing. The finish annealing process consisted of a first annealing performed by soaking in a 75 vol % $N_2$+25 vol % $H_2$ atmosphere at 885° C. for 24 hours, changing the atmosphere to an $H_2$ atmosphere, and then second annealing consisting of purification annealing performed by soaking for 24 hours at the various temperatures shown in Table 2. The C and N contents of the resulting steel sheets and the magnetic characteristics in the rolling direction are also shown in Table 2.

As is clear form Table 2, Steels Nos. 2–7 according to the present invention had low core losses, and the core losses decreased as the C and N contents decreased. Furthermore, as can be seen from the test results for Steels Nos. 4–7, when the purification annealing in the last half of finish annealing is performed in the temperature range specified by the present invention, the C and N contents greatly decrease, and steel sheet having even lower core losses is obtained.

TABLE 2

| Run No. | 2nd Annealing Temperature (°C.) | C and N levels, core loss and flux density of product C (%) | N (%) | $W_{17/50}$ (W/kg) | $B_8$ (T) | Remarks |
|---|---|---|---|---|---|---|
| 1 | 880 | 0.0025 | 0.0065 | 1.30 | 1.78 | X |
| 2 | 900 | 0.0020 | 0.0045 | 1.22 | 1.79 | ○ |
| 3 | 920 | 0.0014 | 0.0030 | 1.17 | 1.79 | ○ |
| 4 | 940 | 0.0009 | 0.0018 | 1.05 | 1.81 | ○ |
| 5 | 960 | 0.0008 | 0.0015 | 1.03 | 1.81 | ○ |
| 6 | 980 | 0.0007 | 0.0010 | 1.02 | 1.82 | ○ |
| 7 | 1000 | 0.0007 | 0.0010 | 1.00 | 1.82 | ○ |

NOTE -
○: Present Invention
X: Comparative

[Example 3]

Three steel types having substantially the same composition within the ranges specified by the present invention but differening with respect to the content of sol. Al (see Table 3) were hot-rolled under the same conditions as in Example 1 and each finished to a thickness of 2.3 mm. The hot-rolled sheets were descaled by pickling and subjected to box annealing by soaking at 800° C. for 2 hours. Subsequently, each of the annealed sheets was cold-rolled to a thickness of 0.35 mm by one stage of rolling.

Each of the cold-rolled sheets was subjected to continuous annealing by soaking at 875° C. for 30 sec in a 80 vol % $N_2$+20 vol % $H_2$ non-decarburizing atmosphere having a dew point of −25° C. or below to cause primary recrystallization, followed by application of a parting agent and finish annealing. The finish annealing process consisted of soaking in a 75 vol % $N_2$+25 vol % $H_2$ atmosphere at 875° C. for 24 hours, shifting to an $H_2$ atmosphere, and purification annealing by soaking t 950° C. for 24 hours. The C and N levels of the resulting steel sheets and their magnetic characteristics in the rolling direction are shown in Table 4.

Steel No. 1 had a smaller amount of sol. Al than specified by the present invention. Even though the C and N contents were within the ranges of the present invention, on account of the weak inhibitor effect, secondary recrystallization characterized by integration in the Goss orientation could not be obtained and it had poor magnetic characteristics. Steel No. 3 had a greater amount of sol. Al and a higher N content than specified by the present invention also had a high N content. No secondary recrystallization was found to have occurred, so Steel No. 3 was very poor with respect to both core loss and magnetic flux density. In contrast, Steel No. 2 corresponding to an example of the electrical steel sheet of the present invention exhibited excellent magnetic characteristics.

TABLE 3

| Run No. | Composition of steel slab (wt %) C | Si | Mn | S | Sol. Al | N | Fe + Impurities |
|---|---|---|---|---|---|---|---|
| 1 | 0.0025 | 3.21 | 3.22 | 0.005 | 0.002 | 0.0037 | Bal. |
| 2 | 0.0027 | 3.20 | 3.20 | 0.005 | 0.006 | 0.0035 | Bal. |
| 3 | 0.0029 | 3.20 | 3.21 | 0.005 | 0.021 | 0.0033 | Bal. |

TABLE 4

| Run No. | C and N levels, core loss and flux density of product C (%) | N (%) | $W_{17/50}$ (W/kg) | $B_8$ (T) | Remarks |
|---|---|---|---|---|---|
| 1 | 0.0008 | 0.0013 | 2.36 | 1.60 | X |
| 2 | 0.0009 | 0.0015 | 1.12 | 1.80 | ○ |
| 3 | 0.0009 | 0.0062 | 4.10 | 1.52 | X |

NOTE -
○: Present Invention
X: Comparative (Example 4)

Steel slabs each consisting of 0.0050% C, 3.31% Si, 3.45% Mn, 0.0006% S, 0.007% sol. Al, 0.0035% N, and a balance of Fe and incidental impurities were prepared by the same method as in Example 1. The slabs were hot rolled under the same conditions as in Example 1 and finished to a thickness of 2.3 mm. The hot rolled sheets were descaled by pickling, cold rolled to a thickness of 1.4 mm, subjected to intermediate annealing by soaking at 850° C. for 1 min, and cold rolled to a thickness of 0.27 mm.

Subsequently, the cold rolled sheets were subjected to continuous annealing by soaking at 875° C. for 30 sec in a 70 vol % $N_2$+30 vol % $H_2$ non-decarburizing atmosphere having a dew point of −15° C. or below to cause primary recrystallization. Thereafter, a parting agent was applied and finish annealing was conducted.

The finish annealing was conducted under the three different conditions set forth in Table 5. The finish annealing process consisted of first annealing comprising soaking in a 50 vol % $N_2$+50 vol % $H_2$ atmosphere for the purpose of achieving secondary recrystallization and second annealing in an $H_2$ atmosphere for the purpose of purification annealing. The C and N levels of the resulting steel sheets and their magnetic characteristics in the rolling direction are shown in Table 6.

Steel No. 1 was subjected to first annealing using a soaking temperature higher than the range specified by the present invention. The inhibitor effect was weak, normal grain growth progressed, and secondary recrystallization did not take place, so even though the C and N contents were within the ranges specified by the present invention, Steel No. 1 had poor magnetic characteristics. Steel No. 3, which was subjected to the second annealing at a lower soaking temperature than specified by the present invention, experienced secondary recrystallization, but since the C and N contents were outside the ranges specified by the present invention, the magnetic characteristics were not satisfactory. In contrast, Steel No. 2 corresponding to an example of the present invention had excellent magnetic characteristics.

TABLE 5

| Run No. | Soaking condition for 1st annealing | Soaking condition for 2nd annealing |
|---|---|---|
| 1 | 960° C. × 24 h | 960° C. × 24 h |
| 2 | 890° C. × 24 h | 960° C. × 24 h |
| 3 | 890° C. × 24 h | 890° C. × 24 h |

TABLE 6

| Run No. | C and N levels, core loss and flux density of product C (%) | N (%) | $W_{17/50}$ (W/kg) | $B_8$ (T) | Remarks |
|---|---|---|---|---|---|
| 1 | 0.0008 | 0.0016 | 2.15 | 1.51 | X |
| 2 | 0.0008 | 0.0017 | 0.92 | 1.80 | ○ |
| 3 | 0.0020 | 0.0062 | 1.27 | 1.78 | X |

NOTE -
○: Present Invention
X: Comparative

[Example 5]

Steel slabs having the compositions shown in Table 7 were hot rolled to a thickness of 2.0 mm. In order to decrease core loss, these test steels had a much high resistivity that conventional oriented magnetic steel sheets, which generally have a resistivity of approximately 50 μΩcm. The balance of Si and Mn in these steels was varied in a manner which maintained the resistivity substantially constant.

Next, the steel sheets were subjected to continuous annealing by soaking at 880° C. for 1 minute followed by descaling by pickling. Then, the sheets were cold rolled to a thickness of 0.30 mm. The temperature of the steel sheets during cold rolling was adjusted by placing the steel sheets in coiled form prior to cold rolling into a box annealing furnace and heating the coiled sheets so that the temperature of the steel sheets at the time of cold rolling was 120°–150° C.

Steels No. 1–3 which had compositions outside the range of the present invention developed cracks in the edge portions of the steel sheets during cold rolling and ended up breaking, so cold rolling to a desired thickness could not be carried out. In contrast, hot rolled Steels No. 4 and 5 according to the present invention suffered no breakage and could be cold rolled to form steel sheets of a desired thickness.

TABLE 7

| Run No. | Composition of stee slab (wt %) C | Si | Mn | S | sol. Al | N | Fe + Impurities | Si (%) - 0.5 × Mn (%) | Resistivity (μΩ · cm) | Remarks |
|---|---|---|---|---|---|---|---|---|---|---|
| 1 | 0.0030 | 6.46* | 0.08 | 0.002 | 0.008 | 0.0042 | Bal. | 6.42* | 82 | X |

TABLE 7-continued

| Run No. | Composition of stee slab (wt %) C | Si | Mn | S | sol. Al | N | Fe + Impurities | Si (%) - 0.5 × Mn (%) | Resistivity (μΩ · cm) | Remarks |
|---|---|---|---|---|---|---|---|---|---|---|
| 2 | 0.0029 | 5.45 | 2.13 | 0.002 | 0.009 | 0.0040 | " | 4.39* | 82 | X |
| 3 | 0.0030 | 4.51 | 4.05 | 0.002 | 0.008 | 0.0038 | " | 2.49* | 82 | X |
| 4 | 0.0035 | 4.02 | 5.00 | 0.002 | 0.007 | 0.0037 | " | 1.52 | 82 | ○ |
| 5 | 0.0030 | 3.85 | 5.20 | 0.002 | 0.009 | 0.0041 | " | 1.25 | 81 | ○ |

NOTE -
*: Outside the range of the present invention
○: Present Invention
X: Comparative

[Example 6]

A cold rolled sheet (0.30 mm thick) obtained by the method of Example 5 and having the composition of Steel No. 4 in Table 7 was subjected to continuous annealing by soaking at 880° C. for 30 seconds in an 75 vol % $N_2$+25 vol % $H_2$ non-decarburzing atmosphere having a dew point of −20° C. so as to cause primary recrystallization, followed by application of a parting agent and a finish annealing. The finish annealing process consisted of a first annealing performed by soaking in a 50 vol % $N_2$+50 vol % $H_2$ atmosphere at 885° C. for 24 hours, changing the atmosphere to a 100% $H_2$ atmosphere, and then second annealing consisting of purification annealing performed by soaking for 24 hours at the various temperatures shown in Table 8. The magnetic characteristics in the rolling direction of the resulting steel sheets are shown in Table 8.

As is clear form Table 8, all the steel sheets had good magnetic characteristics, but when the purification annealing temperature in the last half of finish annealing was in the range defined by the present invention (Steels Nos. 4–7), the steel sheets had even lower core losses.

TABLE 8

| Run No. | Purification Annealing Temperature (°C.) | Core Loss $W_{15/50}$ (W/kg) | Flux Density $B_8$ (T) |
|---|---|---|---|
| 1 | 880 | 0.97 | 1.60 |
| 2 | 900 | 0.91 | 1.60 |
| 3 | 920 | 0.80 | 1.61 |
| 4 | 940 | 0.70 | 1.61 |
| 5 | 960 | 0.69 | 1.62 |
| 6 | 980 | 0.69 | 1.62 |
| 7 | 1000 | 0.68 | 1.62 |

[Example 7]

Slabs of three steel types having substantially the same composition within the ranges specified by the present invention but differing with respect to the content of sol. Al (see Table 9) were hot-rolled and finished to a thickness of 2.3 mm. The hot-rolled sheets were descaled by pickling and subjected to box annealing by soaking at 800° C. for 2 hours. The sheets were then heated to 130° C. by induction heating and cold rolled to a thickness of 0.35 mm.

Each of the cold-rolled sheets was subjected to continuous annealing by soaking at 875° C. for 30 sec in a 80 vol % $N_2$+20 vol % $H_2$ non-decarburizing atmosphere having a dew point of −25° C. or below to cause primary recrystallization, followed by application of a parting agent and finish annealing. The finish annealing process consisted of soaking in a 75 vol % $N_2$25 vol % $H_2$ atmosphere at 875° C. for 24 hours, shifting to an $H_2$ atmosphere, and purification annealing by soaking at 950° C. for 24 hours. The magnetic characteristics in the rolling direction of the resulting steel sheets are shown in Table 10.

Steel No. 1 had a smaller amount of sol. Al than specified by the present invention. On account of the weak inhibitor effect, secondary recrystallization characterized by integration in the Goss orientation could not be obtained and it had poor magnetic characteristics. Steel No. 3 had a greater amount of sol. Al than specified by the present invention. No secondary recrystallization was found to have occurred, so Steel No. 3 had very poor magnetic characteristics. In contrast, Steel No. 2 corresponding to an example of the electrical steel sheet of the present invention exhibited excellent magnetic characteristics.

TABLE 9

| No. | Composition of steel slab (wt %) C | Si | Mn | S | sol. Al | N | Fe + Impurities | Si (%) 0.5 × Mn (%) |
|---|---|---|---|---|---|---|---|---|
| 1 | 0.0025 | 3.51 | 4.22 | 0.003 | 0.002* | 0.0037 | Bal. | 1.4 |
| 2 | 0.0027 | 3.50 | 4.20 | 0.003 | 0.007 | 0.0035 | Bal. | 1.4 |
| 3 | 0.0029 | 3.50 | 4.21 | 0.003 | 0.021* | 0.0033 | Bal. | 1.4 |

NOTE:
*: Outside the range of the present invention

TABLE 10

| Run No. | Core Loss $W_{15/50}$ (W/kg) | Flux Density $B_8$ (T) | Remarks |
|---|---|---|---|
| 1 | 2.35 | 1.50 | X |
| 2 | 0.82 | 1.70 | ○ |
| 3 | 3.95 | 1.42 | X |

NOTE -
○: Present Invention
X: Comparative

[Example 8]

Steel slabs each consisting of 0.0050% C, 3.51% Si, 4.25% Mn, 0.0006% S, 0.006% sol. Al, 0.0035% N, and a balance of Fe and incidental impurities were prepared by the same method as in Example 5 and hot rolled to a thickness of 2.3 mm. The hot rolled sheets were descaled by pickling, cold rolled to a thickness of 1.4 mm, subjected to intermediate annealing by soaking at 850° C. for 1 min, and cold rolled to a thickness of 0.27 mm.

Subsequently, the cold rolled sheets were subjected to continuous annealing by soaking at 875° C. for 30 sec in a 70 vol % $N_2$+30 vol % $H_2$ non-decarburizing atmosphere having a dew point of −15° C. or below to cause primary recrystallization. Thereafter, a parting agent was applied and finish annealing was conducted.

The finish annealing was conducted under the three different conditions set forth in Table 11. The finish annealing process consisted of first annealing comprising soaking in a 50 vol % $N_2$+50 vol % $H_2$ atmosphere for the purpose of achieving secondary recrystallization and second annealing in an $H_2$ atmosphere for the purpose of purification annealing. The magnetic characteristics in the rolling direction of the resulting steel sheets are shown in Table 12.

Steel No. 1 was subjected to first annealing using a soaking temperature higher than the range specified by the present invention. The inhibitor effect was weak, normal grain growth progressed, and secondary recrystallization did not take place, so Steel No. 1 had poor magnetic characteristics. Steel No. 3, which was subjected to the second annealing at a lower soaking temperature than specified by the present invention, experienced secondary recrystallization, but adequate annealing did not take place, so the magnetic characteristics were not satisfactory. In contrast, Steel No. 2 corresponding to an example of the present invention had excellent magnetic characteristics.

TABLE 11

| Run No. | Soaking condition for 1st annealing | Soaking condition for 2nd annealing |
|---|---|---|
| 1 | 960° C. × 24 h | 960° C. × 24 h |
| 2 | 890° C. × 24 h | 960° C. × 24 h |
| 3 | 890° C. × 24 h | 890° C. × 24 h |

TABLE 12

| Run No. | Core Loss $W_{15/50}$ (W/kg) | Flux Density $B_8$ (T) | Remarks |
|---|---|---|---|
| 1 | 2.15 | 1.41 | X |
| 2 | 0.63 | 1.70 | ○ |
| 3 | 0.75 | 1.68 | ○ |

NOTE -
○: Present Invention
X: Comparative

[Example 9]

Hot rolled steel sheets having a thickness of 2 mm and the same composition as in Example 8 were subjected to annealing by soaking at 880° C. for 1 minute, descaled by pickling, heated in an annealing furnace to the various temperatures shown in Table 13, and cold rolled to a thickness of 0.30 mm. The percent of sheets in which breakage occurred during cold rolling is indicated in Table 13.

As can be seen from Table 13, the incidence of breakage was extremely high for Steels Nos. 1 and 2 for which the temperature of the steel sheets during cold rolling was less than 70° C. In contrast, when cold rolling was carried out in the temperature range specified by the present invention (Steels Nos. 4–5), there was virtually no breakage.

TABLE 13

| Run No. | Coil Temperature During Cold Rolling (°C.) | Breakage Ratio During Cold Rolling | Remarks |
|---|---|---|---|
| 1 | 20* | 15/30 | X |
| 2 | 50* | 9/30 | X |
| 3 | 80 | 3/30 | ○ |
| 4 | 120 | 0/30 | ○ |
| 5 | 180 | 0/30 | ○ |

NOTE:
*: Outside the range of the present invention
Breakage Ratio = Number of Broken Sheets/Total Number of Cold Rolled Sheets
○: Present Invention
X: Comparative As demonstrated by the above examples, the oriented magnetic steel sheet of the present invention has a very small core loss and can advantageously be used to make cores in transformers, generators and motors, and magnetic shields.

Furthermore, such a steel sheet can be easily produced by the process of the present invention. Since this process includes neither a decarburization annealing step which takes a prolonged time nor a finish annealing step which is conducted at an extra-high temperature of 1150°–1200° C., it is also advantageous from the viewpoint of lower manufacturing costs.

What is claimed is:

1. A grain-oriented magnetic steel sheet which consists essentially of, on a weight basis:

Si: greater than 3.0% and at most 6.0%,

Mn: greater than 2.0% and at most 8.0%, sol. Al: 0.003–0.015% with Si (%)−0.5×Mn (%)≦2.0 and a balance of Fe and incidental impurities, wherein the amounts of C, N, and S as impurities are C: at most 0.005%, N: at most 0.006%, and S: at most 0.01%.

2. A grain-oriented magnetic steel sheet as claimed in claim 1 wherein the Si content is at most 4.0%.

3. A grain-oriented magnetic steel sheet as claimed in claim 1 wherein the Mn content is at most 4.0%.

4. A grain-oriented magnetic steel sheet as claimed in claim 1 wherein the C content is at most 0.003% and the N content is at most 0.003%.

5. A grain-oriented magnetic steel sheet which consists essentially of, on a weight basis:

Si: greater than 3.0% and at most 4.0%,

Mn: greater than 2.0% and at most 4.0%, sol. Al: 0.003–0.015% with Si (%)−0.5×Mn (%)≦2.0 and a balance of Fe and incidental impurities, wherein the amounts of C, N, and S as impurities are C: at most 0.005%, N: at most 0.006%, and S: at most 0.01%.

6. A grain-oriented magnetic steel sheet as claimed in claim 5 wherein the C content is at most 0.003% and the N content is at most 0.003%.

7. A grain-oriented magnetic steel sheet as claimed in claim 1 wherein the Mn content is greater than 3.0%.

* * * * *